US006464590B2

(12) United States Patent
Leutner et al.

(10) Patent No.: US 6,464,590 B2
(45) Date of Patent: Oct. 15, 2002

(54) HYDRAULIC AGGREGATE WITH AT LEAST ONE DISPLACEMENT MACHINE

(75) Inventors: Volkmar Leutner, Friolzheim (DE); Dieter Bertsch, Neuhausen (DE)

(73) Assignee: Robert Bosch GmbH, Stuttgart (DE)

( * ) Notice: Subject to any disclaimer, the term of this patent is extended or adjusted under 35 U.S.C. 154(b) by 43 days.

(21) Appl. No.: 09/730,279

(22) Filed: Dec. 5, 2000

(65) Prior Publication Data

US 2001/0003574 A1 Jun. 14, 2001

(30) Foreign Application Priority Data

Dec. 8, 1999 (DE) ..... 199 59 020

(51) Int. Cl.[7] ..... F16D 3/48; F04D 17/00
(52) U.S. Cl. ..... 464/137; 417/273; 417/359
(58) Field of Search ..... 464/181, 137; 417/273, 359; 91/492; 92/72

(56) References Cited

U.S. PATENT DOCUMENTS

| | | | | | |
|---|---|---|---|---|---|
| 2,293,692 | A | * | 8/1942 | Wylie | 91/492 |
| 3,708,250 | A | * | 1/1973 | Thumm | 417/221 |
| 3,750,533 | A | * | 8/1973 | Thoma | 91/498 |
| 3,793,923 | A | * | 2/1974 | Smith | 91/488 |
| 3,961,562 | A | * | 6/1976 | Kersten et al. | 91/492 |
| 4,056,042 | A | * | 11/1977 | Rutz et al. | 91/497 |
| 4,648,579 | A | * | 3/1987 | Wilson | 248/638 |
| 4,920,859 | A | * | 5/1990 | Smart et al. | 91/497 |
| 5,081,907 | A | * | 1/1992 | Nagel et al. | 94/497 |
| 5,201,260 | A | * | 4/1993 | Fetting et al. | 91/491 |
| 5,848,565 | A | * | 12/1998 | Thoma | 91/491 |

FOREIGN PATENT DOCUMENTS

| | | |
|---|---|---|
| DE | 82 26 081.8 | 2/1984 |
| DE | 86 10 082.3 | 7/1986 |
| DE | 196 28 781 A1 | 1/1998 |
| DE | 196 95 488 A1 | 1/1998 |
| DE | 197 03 112 A1 | 7/1998 |
| DE | 197 40 436 A1 | 3/1999 |
| EP | 0 886 067 A1 | 12/1998 |

* cited by examiner

*Primary Examiner*—Lynne H. Browne
*Assistant Examiner*—Kenn Thompson
(74) *Attorney, Agent, or Firm*—Michael J. Striker

(57) ABSTRACT

A hydraulic aggregate has at least one displacing machine having a driving mechanism, a driving/driven shaft, and a compensating coupling connecting the driving/driven shaft with the driving mechanism, and at least one machine unit connected with the driving/driven shaft of the displacement machine through a component, the compensating coupling between the driving mechanism and the driving/driven shaft of the displacement machine compensating a radial and an axial offset between the displacing machine and the machine unit.

13 Claims, 5 Drawing Sheets

HYDRAULIC AGGREGATE WITH AT LEAST ONE DISPLACEMENT MACHINE

BACKGROUND OF THE INVENTION

The present invention relates to a hydraulic aggregate with at least one displacement machine, in particular a radial piston machine such as a pump or motor.

All displacement machines, such as hydraulic pumps and motors operate in accordance with the displacement principle. A fluid is supplied at an inlet side into an increasing displacement chamber, the chamber is closed, then it is connected with a discharge side and the fluid is discharged from the reducing displacement chamber. The displacement machines operate in accordance with a rotary displacement principle and a rectilinear displacement principle. Rotary displacement machines provide feeding in cells, whose volume cyclically changes by the geometric design of the limiting walls, such as for example gear machines, screw machines, vane cell machines, etc. The rectilinear displacement machines change the cell volumes by a reciprocating movement of a piston in a cylinder, for example axial piston machines, radial piston machines, etc.

Radial piston machines, such as pumps or motors, have a driving mechanism with a cylinder-piston unit and an adjusting element acting on the piston. The pistons as a rule are radially displaceably guided in a cylinder star. The adjusting element can be formed for example as a lifting ring or an eccentric, which can be arranged radially inside the piston or radially outside the piston. Basically the adjustment elements of the cylinder stars can be rotatable.

A driving/driven shaft is operatively connected with the rotating part of the driving mechanism. In a pump it transmits a torque from outside inwardly to the driving mechanism, and in a motor it transmits a torque from the driving mechanism outwardly. The driving/driven shaft of the radial piston machine extends as a rule outwardly through a cover and is supported in the cover and/or the housing of the radial piston machine. For compensating an axial and/or radial offset between the driving mechanism and the shaft, it is known to provide a compensating coupling between the driving mechanism and the shaft.

A component of a machine unit is connected with the free end of the driving/driven shaft of the radial piston machine. In particular, it was a shaft, or also it can be a toothed gear. The machine unit as a rule is formed in a radial piston pump by a motor, and in a radial piston motor it is formed by a consumer or a generator.

For compensating a radial and an axial offset between the driving/driven shaft of the radial piston machine and the component of the machine unit, it is known to arrange a second compensating coupling between the component and the driving/driven shaft.

Furthermore, the European patent document EP 0886 067 A1 discloses a hydraulic aggregate with a drive unit and a pump unit. The drive unit and the pump unit are flanged over one another. An input shaft of the pump unit operates as a centering element for a drive shaft of the drive unit. The drive shaft is connected directly form-lockingly with the input shaft of the pump unit and supported by bearing points of the input shaft and through a further bearing in the housing of the drive unit.

SUMMARY OF THE INVENTION

Accordingly, it is an object of present invention to provide a hydraulic aggregate with at least one displacing machine, which avoids the disadvantages of the prior art.

More particularly, it is an object of present invention to provide a hydraulic aggregate with at least one displacement machine, in particular a radial piston machine such as a pump or a motor, which has a drive mechanism and a driving/driven shaft connected to it via a compensation coupling, and at least one machine unit which is connected operatively through a component with the driving/driven shaft of the displacement machine.ion.

It is proposed that the compensating coupling between the driving mechanism and the driving/driven shaft of the displacement machine compensates a radial and/or axial offset between the displacement machine and the machine unit. An additional compensating coupling between the driving/driven shaft and the component of the machine unit can be dispensed with and the structural length, the mounting expenses and the cost can be reduced.

A required freedom degree of the driving/driven shaft is advantageously provided since a bearing of the driving/driven shaft is eliminated, it is fixedly connected with the component of the machine unit, and it is supported by bearing points of the component. Additional components, such as for example a bearing and a bearing cover, are eliminated, an overdimensioned bearing as well as undeterminable forces on the displacement machine or on the driving mechanism can be avoided, and advantageously standard machine units can be utilized. The machine unit can be formed, for example, as a standard electric motor whose drive shaft is supported in two bearings in a statistically determined manner and fixedly connected with a drive shaft of the displacement machine. The machine unit can be produced independently from the displacement machine and can be tested for its operation.

The component of the machine unit connected with the driving/driven shaft of the displacement machine is very often formed as a shaft, for example a drive shaft in an electric motor, as an input shaft in a consumer or a generator, etc. Further, it can be formed as a toothed gear or another, suitable component. An especially simple and fast connection between the driving/driven shaft of the displacement machine and a shaft of the machine, and a shaft of the machine unit can be provided with a driving/driven shaft of the displacement machine formed as a hollow shaft, which can be mounted on the shaft of the machine unit. Furthermore, a hollow shaft can be adjusted to standard shafts of the machine units in an especially cost-favorable manner.

The driving/driven shaft and the component of the machine unit can be formed of one piece. For example, a driving shaft on an electric motor or an input shaft of a generator can be connected directly with the driving mechanism of the displacement machine through the compensating coupling. Additional components, structural length, mounting expenses and cost can be spared.

Instead of completely eliminating a bearing of the driving/driven shaft, it can be advantageous to support it in a housing part through a pendulum bearing. This bearing, together with a compensating coupling, can compensate for alignment errors, such as for example a radial offset, end running deviations, etc. The displacement machine can be connected with standard machines in an advantageous manner, such as with conventional motor shafts or standard electric motors which have no bearing on the driven shaft. An oversized bearing can be advantageously avoided. The pendulum bearing can be formed as a pendulum ball bearing or a pendulum roller bearing.

Various devices which are known for those skilled in the art can be used as a compensating coupling. It is especially advantageous when the compensation coupling is formed as a cross disk coupling. The cross disk coupling is especially short, it can compensate radial and axial gaps, and is frequently provided in a standard fashion between the driving mechanism and the driving/driven shaft of the displacing machine, in particular radial piston machines. A new construction can be avoided, and for the displacement machine technically effective and cost favorable standard structural groups can be utilized.

A part of the compensation coupling can be mounted on the driving/driven shaft. Also, a part of the compensation coupling can be preferably formed on the driving/driven shaft with one piece with it, for example with a so-called loop of a cross disk coupling, and guided in a cross slider of the cross disk coupling.

In accordance with one embodiment of the present invention it is suggested that the displacement machine and the machine unit are connected with one another through a separate intermediate housing. Separate intermediate housing can be adjusted in an especially flexible and cost favorable manner to different machine units. Thereby a displacement machine or a housing of a structural row, for example radial piston pumps with different feeding volumes, can be mounted on different machine types via the intermediate housing in an especially flexible and cost favorable manner. For example, they can be mounted on electric motors with different powers and/or different dimensions. Basically, the intermediate housing can be also formed of one piece with the housing of the displacement machine or the housing of the machine unit.

In accordance with another embodiment of the present invention, the intermediate housing of the displacement machine is sealed from outside. An additional cover of the displacement machine is therefore eliminated.

The displacement machine can be sealed in direction of the machine unit through a wall of the machine unit and possibly through a special shaft seal of a shaft of the machine unit. It is especially advantageous however when the displacement machine is sealed by a sealing on the driving/driven shaft of the displacement machine in direction of the machine unit. A special sealing of the machine unit therefore can be avoided, and the machine unit can be formed as a cost favorable standard component. Furthermore, the displacement machine can form a close unit with the intermediate housing sealing the driving/driven shaft, which can be separately manufactured and tested for its operation.

Since in accordance with the present invention the compensation of coupling between the driving mechanism and the driving/driven shaft can be used for an offset compensation between the displacement machine and the machine unit, a required freedom is provided for uncoupling the displacement machine and the machine unit with respect to the body sound. This can be achieved by a damping element, which for example is arranged between the intermediate housing and a housing of the machine unit. It is especially advantageous however when the damping element is formed of one piece with the intermediate housing. Thereby additional components, structural length and mounting expenses can be saved. This can be achieved for example with intermediate housing which is composed of vibration-dampening plastic or metal.

The inventive solution can be utilized for different hydraulic aggregates. It is especially advantageous for radial piston machines, in which frequently the driving mechanism and the driving/driven unit are separate and are connected with a compensation coupling.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
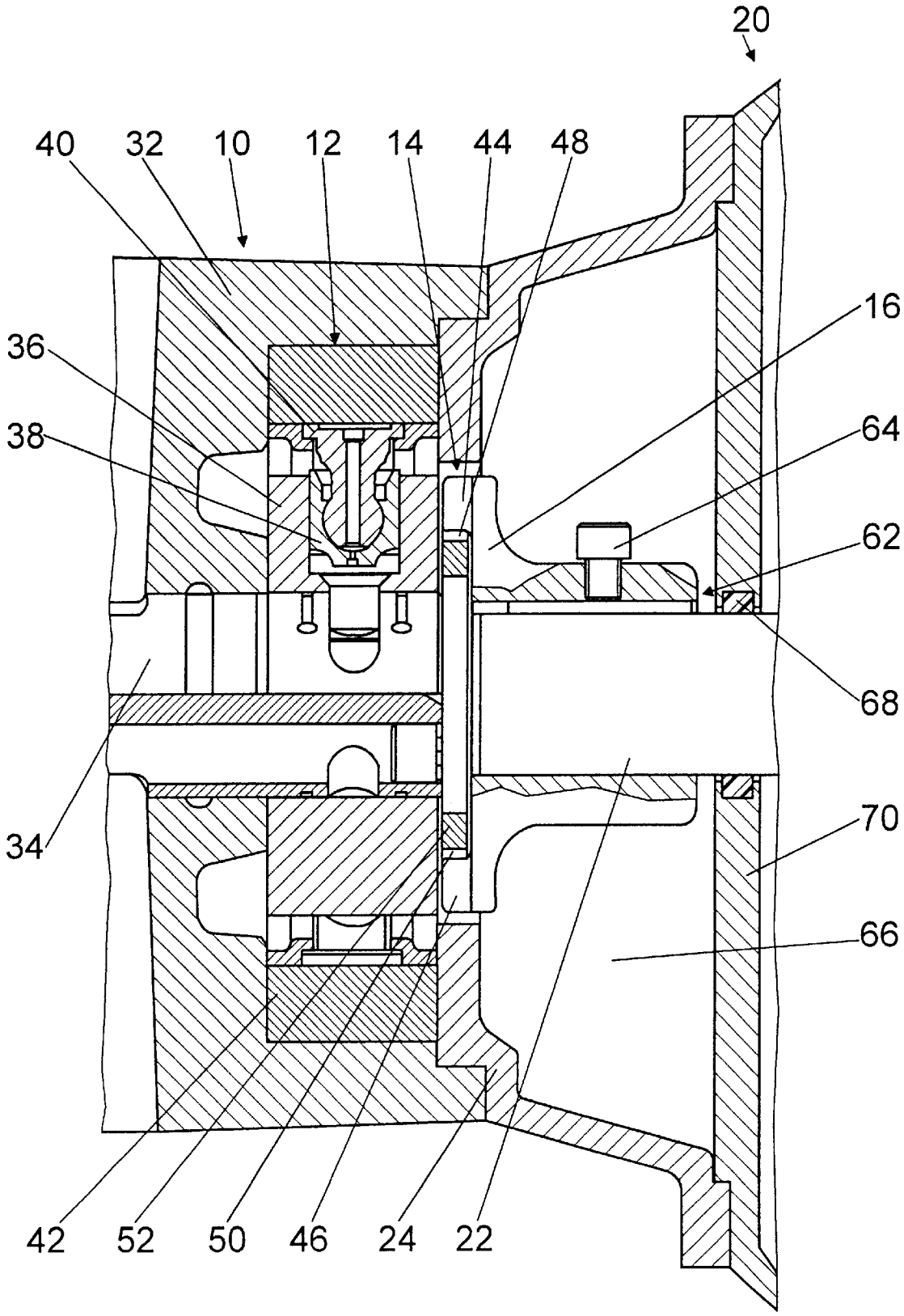
FIG. 1 is a view showing a part of a longitudinal section through a radial piston pump and an electric motor in accordance with the present invention.

FIG. 1 shows a hydraulic aggregate with a radial piston pump 10, which has a housing 32 and a driving mechanism 12 arranged in the housing. The driving mechanism 12 has a cylinder star 36 which is supported and rotates on a control pin 34. Seven pistons 38 are radially displaceably arranged in the cylinder star 36 and symmetrically distributed over the periphery. The pistons 37 are supported through sliding shoes 40 radially outwardly on a displaceable stroke ring 42.

Figure 2:
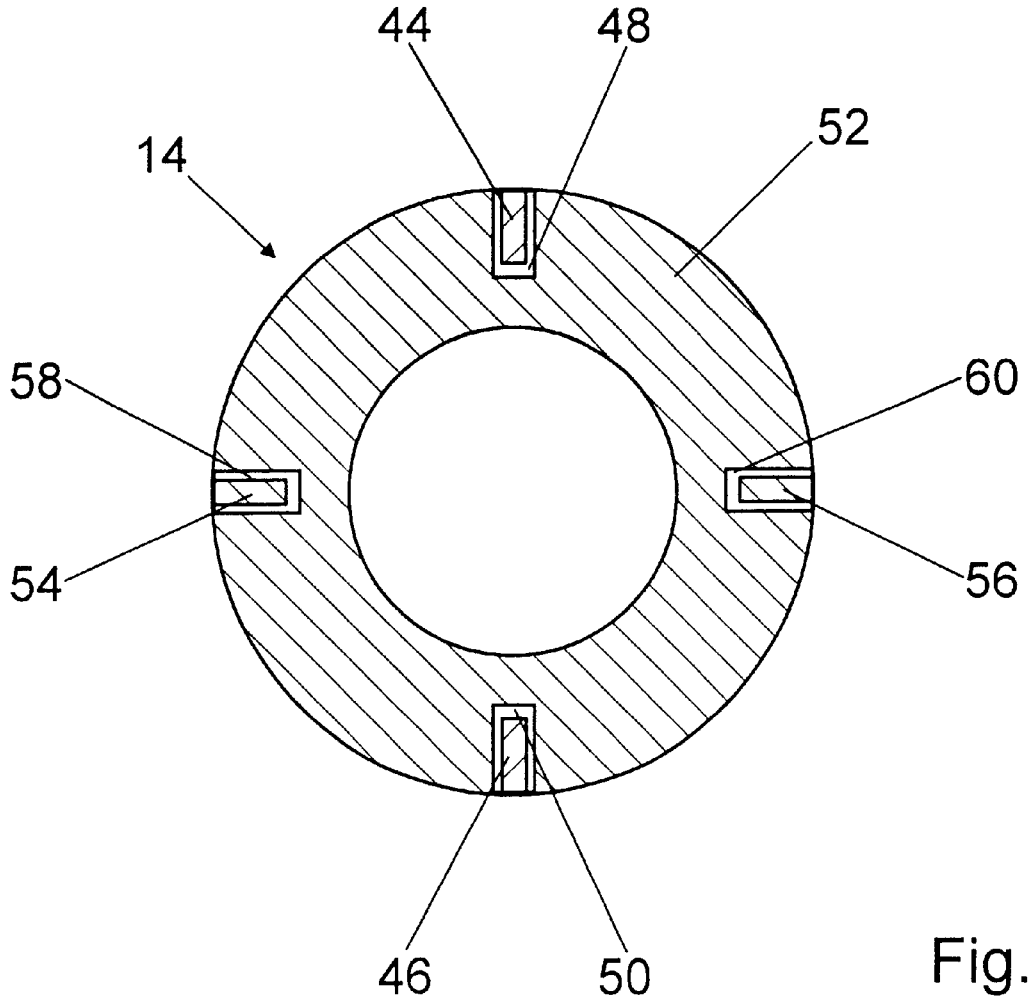
FIG. 2 is a view showing a section of a compensation coupling of FIG. 1, in accordance with the present invention.

The cylinder star 36 is connected with a driving shaft 16 of the radial piston pump 10 through a cross disk coupling 14. The driving shaft 16 forms a part of the cross coupling 14. In particular, the driving shaft 16 engages with two pins 44 and 46 into recesses 48 and 50 of a cross slide 52 as shown in FIGS. 1 and 2. Furthermore, the cylinder star 36 forms a part of the star disk coupling 14. In particular it engages with two pins 54 and 56 into recesses 58 and 60 of the cross slide 52.

The driving shaft 16 is formed as a hollow shaft. It is mounted on a motor shaft 22 of an electric motor 20 through a key connection 62. In an axial direction the driving shaft 16 is fixed on the motor shaft 22 through a disk 64. The driving shaft 16 is supported in a statically determined manner through not shown bearing points on the motor shaft 22.

In accordance with the present invention radial and axial offsets between the radial piston pump 10 and the electric motor 20 are compensated by the cross disk coupling 14. The screw 64 can adjust a desired axial gap in the cross disk coupling 14 during the mounting.

The radial piston pump 10 and the electric motor 20 are connected through a separate intermediate housing 24. It seals the radial piston pump from outside, at the side facing the electric motor 20. An intermediate space 66 which is enclosed by the intermediate housing 24 between the radial piston pump 10 and the electric motor 20 is open in direction of the radial piston pump 10. Thereby a fluid to be fed can reach the intermediate chamber 66. The electric motor 20 is sealed through a special shaft seal 68 relative to the intermediate space 66, which is arranged in a cover 70 of the electric motor housing. The seal can be arranged also directly in the electric motor housing.

Figure 3:
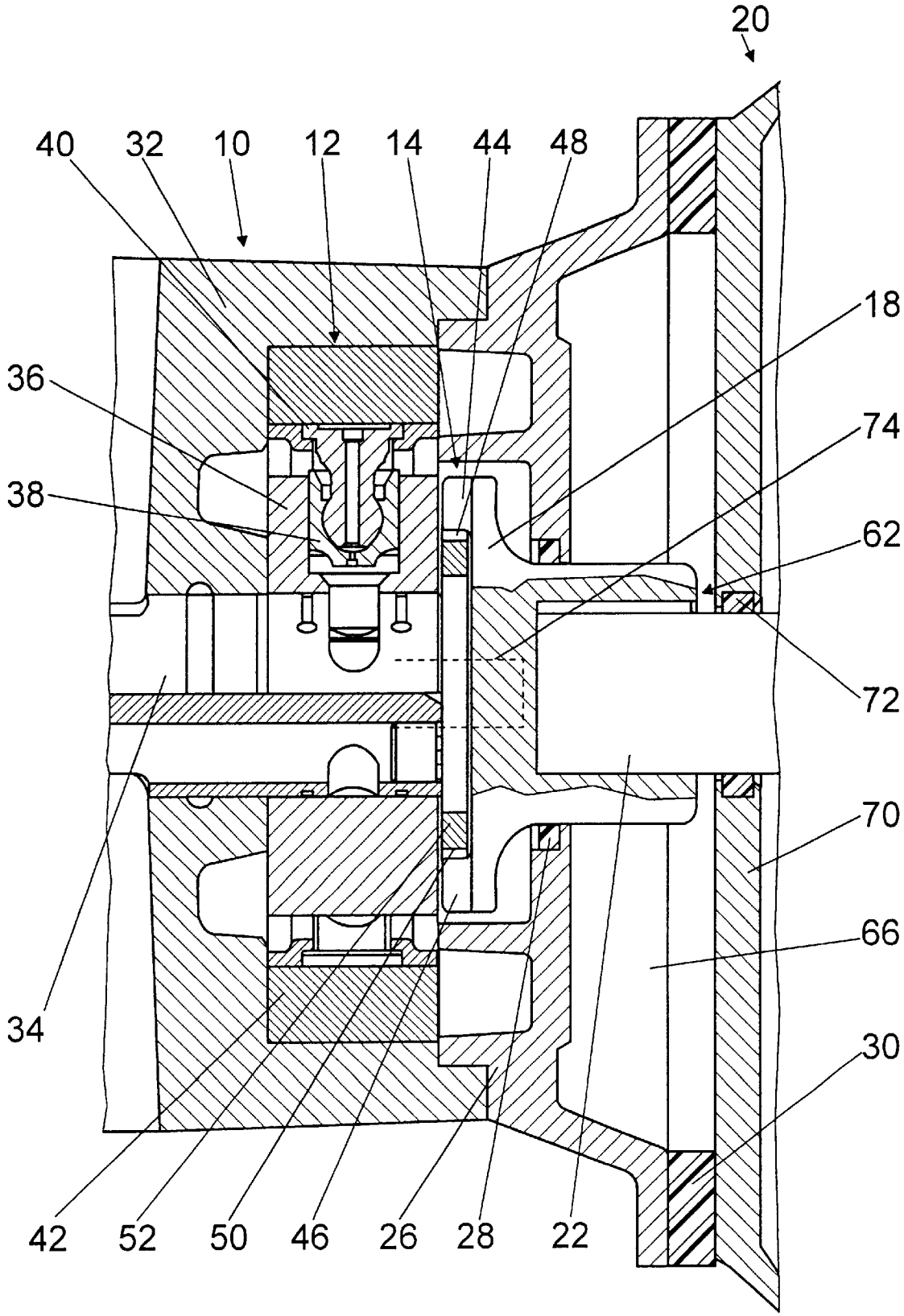
FIG. 3 is a view showing a variant of the compensation coupling of FIG. 1 in accordance with the present invention.

FIG. 3 shows a variant of the embodiment of FIG. 1, with an alternative intermediate housing 26 and a driving shaft 18. Substantially similar components are identified with the same reference numerals. The intermediate housing 26 seals the radial piston pump 10 on the driving shaft 18 from outside through a seal 26. The intermediate chamber 66 which is enclosed by the intermediate housing 26 is sealed in direction of the radial piston pump 10. Thereby the electric motor 20 can be sealed by a standard shaft seal 72 in the cover 70.

The intermediate housing 26 is mounted on the cover 70 of the electric motor 20 through a sealing ring 30 composed of a vibration-damping plastic. This prevents a transmission of body sound from the radial piston pump 10 through the intermediate housing 26 to the electric motor 20, and vice versa. Instead of a vibration-damping synthetic plastic, also another vibration damping material can be used, which is known to a person skilled in the art. In the embodiment shown in FIG. 1, the damping element and the intermediate housing 24 are formed of one piece with one another. In particular, the intermediate housing 24 is composed of a vibration-damping metal.

The inventive solution provides a through drive possibility, or the possibility to connect several displacement machines (pump or motors) with one machine unit, for example with an electric motor or a generator. The driving shaft 18 can be for example guided through the radial piston pump 10 and connected with the shaft 74 which is connected with further radial piston pumps as shown in FIG. 3.

Figure 5:
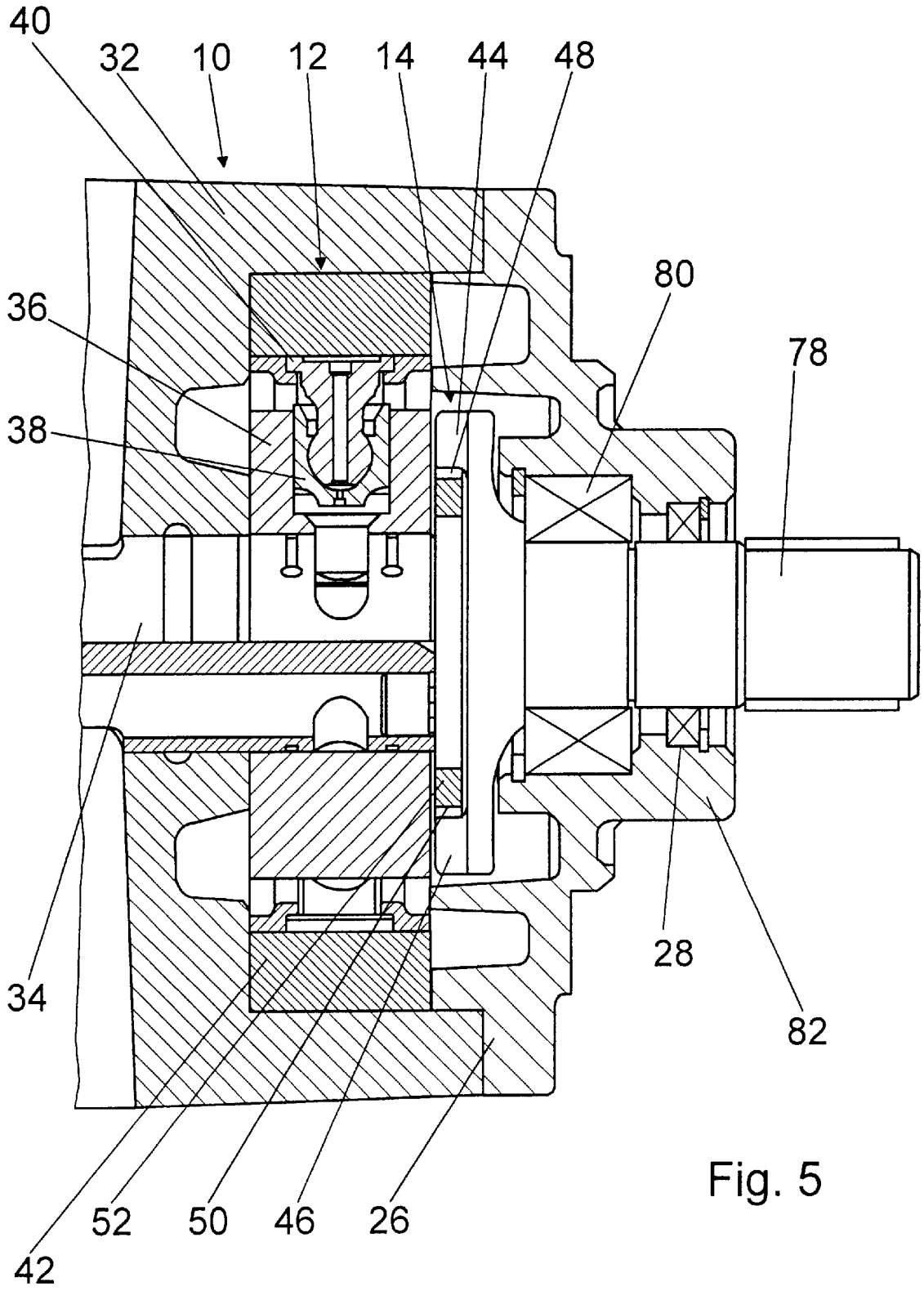
FIG. 5 is a view showing a variant of FIG. 3 with a pendulum roller bearing, in accordance with the present invention.

FIG. 5 shows a variant of the embodiment of FIG. 2. Here a driving shaft 78 of a radial piston pump 10 is supported in an intermediate housing 82 through a pendulum roller bearing 80. The pendulum roller bearing 80 and the cross drive coupling 14 can compensate alignment errors between a not shown motor shaft and the driving shaft 78. The driving shaft 78 is connectable with a standard motor shaft which at the driven side has no bearing.

Figure 4:
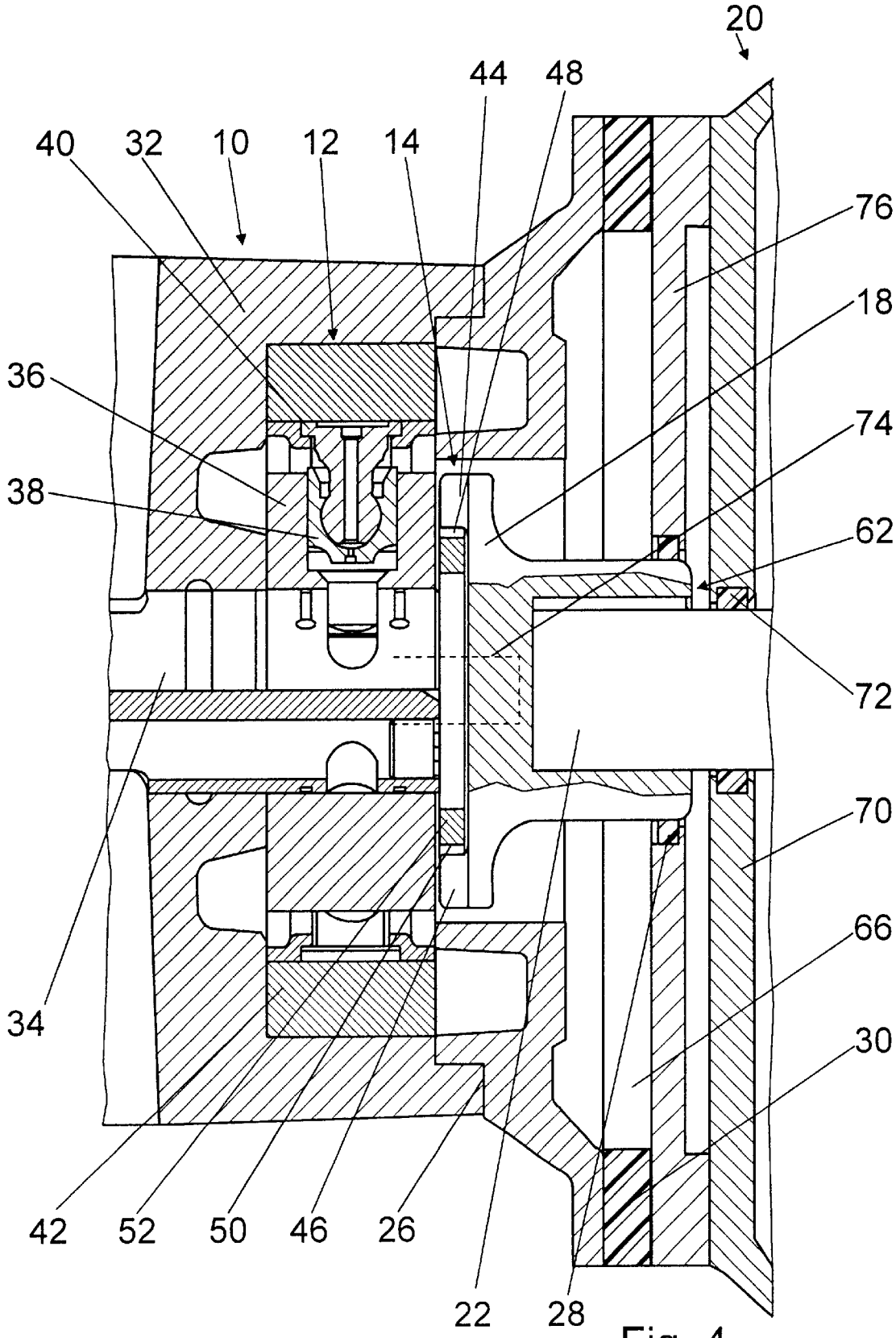
FIG. 4 is a view showing a variant of FIG. 3, with a flange which is fixedly connected with a machine unit.

FIG. 4 shows an embodiment in which the seal 28 is arranged in a flange 76 fixedly connected with the machine unit 20, and the damping element 30 is arranged at the side of the flange 76 which faces the displacement machine 10. With the additional flange 76 it is advantageous to provide that the vibrations of the displacing machine 10 are compensated by the damping element 30 without action of the compensation movements of the damping element 30 on the seal 28.

It will be understood that each of the elements described above, or two or more together, may also find a useful application in other types of constructions differing from the types described above.

While the invention has been illustrated and described as embodied in hydraulic aggregate with at least one displacement machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A hydraulic aggregate, comprising at least one displacing machine having a driving mechanism, a driving/driven shaft, and a compensating coupling connecting said driving/driven shaft with said driving mechanism; and at least one machine unit having a component and connected with said driving/driven shaft of said displacement machine through a component, said compensating coupling between said driving mechanism and said driving/driven shaft of said displacement machine compensating a radial and an axial offset between said displacing machine and said machine unit.

2. A hydraulic aggregate as defined in claim 1, wherein said driving/driven shaft is fixedly connected with said component of said machine unit and is supported through bearing points of said component.

3. A hydraulic aggregate as defined in claim 1, wherein said driving/driven shaft of said displacement machine is formed as a hollow shaft, said component of said machine unit being formed as a shaft, and said driving/driven shaft of said displacement machine being mounted on said shaft of said machine unit.

4. A hydraulic aggregate as defined in claim 1, wherein said driving/driven shaft of said displacement machine and said component of said machine unit are formed of one piece with one another.

5. A hydraulic aggregate as defined in claim 1; and further comprising a pendulum bearing through which said driving/driven shaft of said displacement machine is supported in said component.

6. A hydraulic aggregate as defined in claim 1, wherein said compensating coupling is formed as a cross disk coupling.

7. A hydraulic aggregate as defined in claim 1, wherein said driving/driven shaft of said displacement machine is formed of one piece with at least a part of said compensating coupling.

8. A hydraulic aggregate as defined in claim 1; and further comprising a separate intermediate housing through which said displacement machine and said machine unit are connected with one another.

9. A hydraulic aggregate as defined in claim 8, wherein said intermediate housing seals said displacement machine from outside.

10. A hydraulic aggregate as defined in claim 9, wherein said intermediate housing of said displacement machine is sealed on said driving/driven shaft by a seal.

11. A hydraulic aggregate as defined in claim 10; and further comprising a damping element through which said displacement machine and said machine unit are connected with one another.

12. A hydraulic aggregate as defined in claim 11, wherein said seal is arranged in a flange which is fixedly connected with said machine unit, and said damping element being arranged at a side of said flange which faces toward said displacement machine.

13. A hydraulic aggregate as defined in claim 11, wherein said damping element is formed of one piece with said intermediate housing.

* * * * *